US008469455B2

(12) United States Patent
Hackelboerger et al.

(10) Patent No.: US 8,469,455 B2
(45) Date of Patent: Jun. 25, 2013

(54) METHOD FOR CONTROLLING A CUTTING EXTRACTION MACHINE

(75) Inventors: Bernhard Hackelboerger, Castrop-Rauxel (DE); Fiona Mavroudis, Aachen (DE); Reik Winkel, Aachen (DE); Karl Nienhaus, Raeren (BE)

(73) Assignee: Eickhoff Bergbautechnik GmbH, Bochum (DE)

( * ) Notice: Subject to any disclaimer, the term of this patent is extended or adjusted under 35 U.S.C. 154(b) by 285 days.

(21) Appl. No.: 12/449,187

(22) PCT Filed: Jul. 28, 2008

(86) PCT No.: PCT/EP2008/006204
§ 371 (c)(1),
(2), (4) Date: Jul. 27, 2009

(87) PCT Pub. No.: WO2010/012286
PCT Pub. Date: Feb. 4, 2010

(65) Prior Publication Data
US 2010/0259091 A1 Oct. 14, 2010

(51) Int. Cl.
*E21C 35/08* (2006.01)

(52) U.S. Cl.
USPC ..... 299/1.6; 299/1.1

(58) Field of Classification Search
USPC ..... 299/1.4, 39.1, 39.4, 39.5, 39.6, 41.1, 299/42, 43, 44, 45, 79.1, 85.1, 80.1, 1.05, 299/1.1, 1.6, 1.7
See application file for complete search history.

(56) References Cited

U.S. PATENT DOCUMENTS

| | | | | |
|---|---|---|---|---|
| 3,069,654 A | | 12/1962 | Hough | |
| 4,155,594 A | * | 5/1979 | Hartley et al. | 299/1.1 |
| 4,715,657 A | | 12/1987 | Sato et al. | |

FOREIGN PATENT DOCUMENTS

| | | |
|---|---|---|
| CA | 1 229 675 | 11/1987 |
| EP | 0 105 867 | 4/1984 |
| WO | WO 2006/119534 | 11/2006 |

OTHER PUBLICATIONS

International Search Report in German.
"Hough transform"—Wikipedia, the free encyclopedia, pp. 1-9, retrieved on Dec. 12, 2012.
"Edge detection"—Wikipedia, the free encyclopedia, pp. 1-7, retrieved on Dec. 12, 2012.

* cited by examiner

*Primary Examiner* — Sunil Singh
(74) *Attorney, Agent, or Firm* — Collard & Roe, P.C.

(57) ABSTRACT

The invention relates to a method for controlling a cutting extraction machine, which can be moved along a working front in longwall mining, in which method the heat emission of the working face (4) newly exposed by the extraction machine, in each instance, is observed using an infrared camera (10), and control data for the subsequent extraction run are generated on the basis of this observation. In order to make this method problem-free and more useful for practical situations, the invention proposes that observation of the heat radiation takes place perpendicular to the working face (4) and at a minimum distance from the cutting tools of the extraction machine, that a key bed package (X) having a characteristic sequence of border surfaces between layers of different heat conductivity is determined, that at the end of each extraction run, the progression of this key bed package (X) is determined, with reference to the delimitation surfaces of the longwall, on the basis of the heat images, and that the control data for the next extraction run of the extraction machine are generated on the basis of this progression of the key bed package.

5 Claims, 3 Drawing Sheets

METHOD FOR CONTROLLING A CUTTING EXTRACTION MACHINE

CROSS REFERENCE TO RELATED APPLICATIONS

Figure 1:
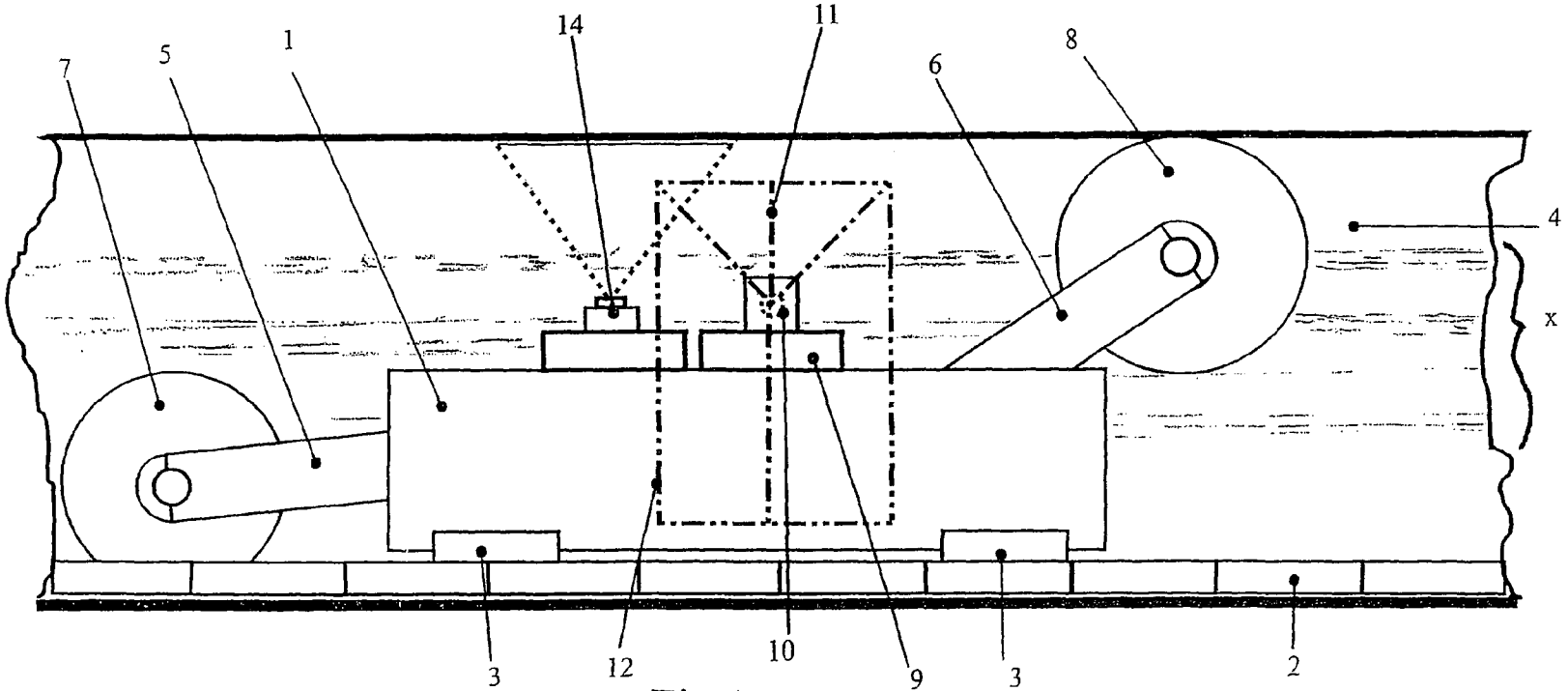

This application is the National Stage of PCT/EP2008/006204 filed on Jul. 28, 2008. The international application under PCT article 21(2) was not published in English.

The invention relates to a method for controlling a cutting extraction machine, particularly one used in coal mining, which can be moved in a longwall along a working front in longwall mining, in which method the heat radiation of the working face newly exposed by the extraction machine, in each instance, is observed using at least one infrared camera assigned to the extraction machine, and control data for the subsequent extraction run of the extraction machine are generated on the basis of this observation.

Such a method is known from WO 2006/119534 A1. The known method proceeds from the phenomenon known to every miner or geologist, that in seam deposits, for example in coal seam deposits, thin layers of rock are often embedded in the material to be extracted, which run parallel to the roof and the floor of the seam. Tying in with this, the method mentioned above proceeds from the idea that when using cutting extraction machines in seams having such embedded rock layers, more energy (friction heat) is introduced into these rock layers during the extraction work than into the surrounding coal, and that therefore these embedded rock layers heat up more than the surrounding coal. This increased heating is supposed to be detected using an infrared camera in the known methods, in order to thereby measure the distance of these embedded rock layers from the upper and/or lower delimitation surface of the longwall in this way, and to control the extraction machine, during the next extraction run, on the basis of this measurement.

So that as little of the introduced heat as possible is lost between the engagement region of the extraction tools and the measurement with the infrared camera, the heat radiation is supposed to be measured as close as possible and immediately adjacent to the engagement region of the extraction tools of the extraction machine.

However, the known method has not proven itself in practice, specifically for various reasons. For one thing, warming as the result of the cutting work that is introduced is not significantly greater, particularly in the case of thin rock layers or layers composed of soft or brittle rock, than in the surrounding coal. For another thing, there are multiple problems that result in a measurement in the region directly adjacent to the cutting zone of the extraction machine, which make a sufficiently precise determination of the heat radiation almost impossible. First of all, for space reasons, the optical axis of the infrared camera must be disposed at a slant to the working face, which results in a trapezoid distortion of the measurement field. In addition, this distorted measurement field is in the region of very great dust stress, and furthermore, water is sprayed to keep the dust down. Dust and water mist also significantly hinder measuring the heat radiation of the newly exposed working face. Finally, it can occur that an embedded rock layer runs out in a wedge or is otherwise lost during the course of the seam. In this case, control oriented with regard to this rock layer would lose its orientation.

It is therefore the task of the invention to further develop the method of the type stated initially, to the effect that it becomes useful for practical situations and avoids the problems indicated above.

To accomplish this task, the invention proposes, proceeding from the method of the type stated initially, a) that observation of the heat radiation of the working face takes place perpendicular to the working face, and that the edges of the measurement field recorded by the infrared camera, seen in the longitudinal direction of the longwall, have a distance from the cutting tools of the extraction machine that corresponds to at least half the width of the measurement field, b) that in the observation of the heat radiation of the working face, a differential heat temperature conductivity region or "key bed package" having a characteristic sequence of border surfaces between layers of different heat conductivity is determined, c) that at the end of each extraction run, the progression of this key bed package is determined, with reference to the upper and lower delimitation surface of the longwall, on the basis of the heat images recorded during this extraction run, d) and that the control data for the next extraction run of the extraction machine are generated on the basis of this progression of the key bed package.

In deviation from the previously known method, the method according to the invention no longer orients itself on the basis of the harder rock layers embedded in the coal seam, but rather on the basis of the layer structure of the coal seam itself. It is known that coal seams do not have a homogeneous structure, because of their formation history, but rather consist of strips deposited on top of one another, in different thickness, which are called macerals (e.g. vitrite, durite, clarite, or fusite) and have different physical and chemical properties. The different physical properties include heat conductivity, among others.

At the newly exposed working face, a flow of heat from the warmer rock mass into the cooler air of the longwall space takes place. However, this heat flow is not uniform over the thickness of the seam, but rather more intensive where the coal being exposed has greater heat conductivity, and less where the heat conductivity of the coal being exposed is lower. In total, there is a special temperature profile, seen over the entire thickness of the coal seam, which is characteristic for this coal seam—similar to a fingerprint.

The sequence of border surfaces between layers having different heat conductivity is particularly characteristic. These border surfaces can be recognized during observation with an infrared camera in that a relatively great temperature difference over a small thickness range is measured in the region of these border surfaces. In this manner, it is possible to define a key bed package having a particular characteristic sequence of border surfaces between layers having different heat conductivity, within the coal seam, and to use the position of this key bed package within the seam to generate control data.

This fundamentally new kind of determination of a key bed package allows disposing the infrared camera at such a distance from the cutting zone of the extraction machine that the measurement can no longer be impaired by a distortion of the measurement field, by dust or water mist. In this way, it is particularly possible to draw up a significantly more precise and finely differentiated heat image of the coal face, and to define the key bed package as discussed above in the coal seam on the basis of this heat image.

According to a particularly preferred embodiment of the method according to the invention, it is provided that the heat images are recorded during the extraction run along the working face, at regular intervals, as a function of the path, and that they are joined together, at the end of the extraction run, to produce an overall heat image of the working face, which shows the progression of the key bed package with reference to the upper and/or lower delimitation surface of the longwall, and that subsequently, the control data for the next extraction run of the extraction machine are generated on the basis of this overall heat image, automatically or with human assistance.

Joining of the individual heat images to produce an overall heat image of the working face has the advantage that individual incorrect measurements can be eliminated in simple manner, by means of interpolation. An evaluation of the overall heat image with human assistance has the additional advantage that mining experience concerning the presumed progression of the seam can be taken into consideration, if necessary, in generating the control data.

It is practical if, in the determination of the key bed package, the border surfaces between the layers having different heat conductivity are determined by means of edge detection (Hough transformation). Using this method, it is possible to determine the border surfaces between layers having different heat conductivity from the extremely great number of data of the individual heat images and of the overall heat image, in simple manner, and the key bed package explained above can be defined with a characteristic sequence of such border surfaces.

A particularly advantageous further development of the method according to the invention provides that in addition, a heat image of the newly exposed upper delimitation surface of the longwall, in each instance, is produced using at least one additional infrared camera, and that this additional heat image is analyzed with regard to the presence of coal or rock, and used for generating control data for the next extraction run of the extraction machine. This additional infrared camera merely provides a probability value for coal or incidental rock being cut. The data obtained with this camera are included in the generation of the control data for the next extraction run.

Figure 2:
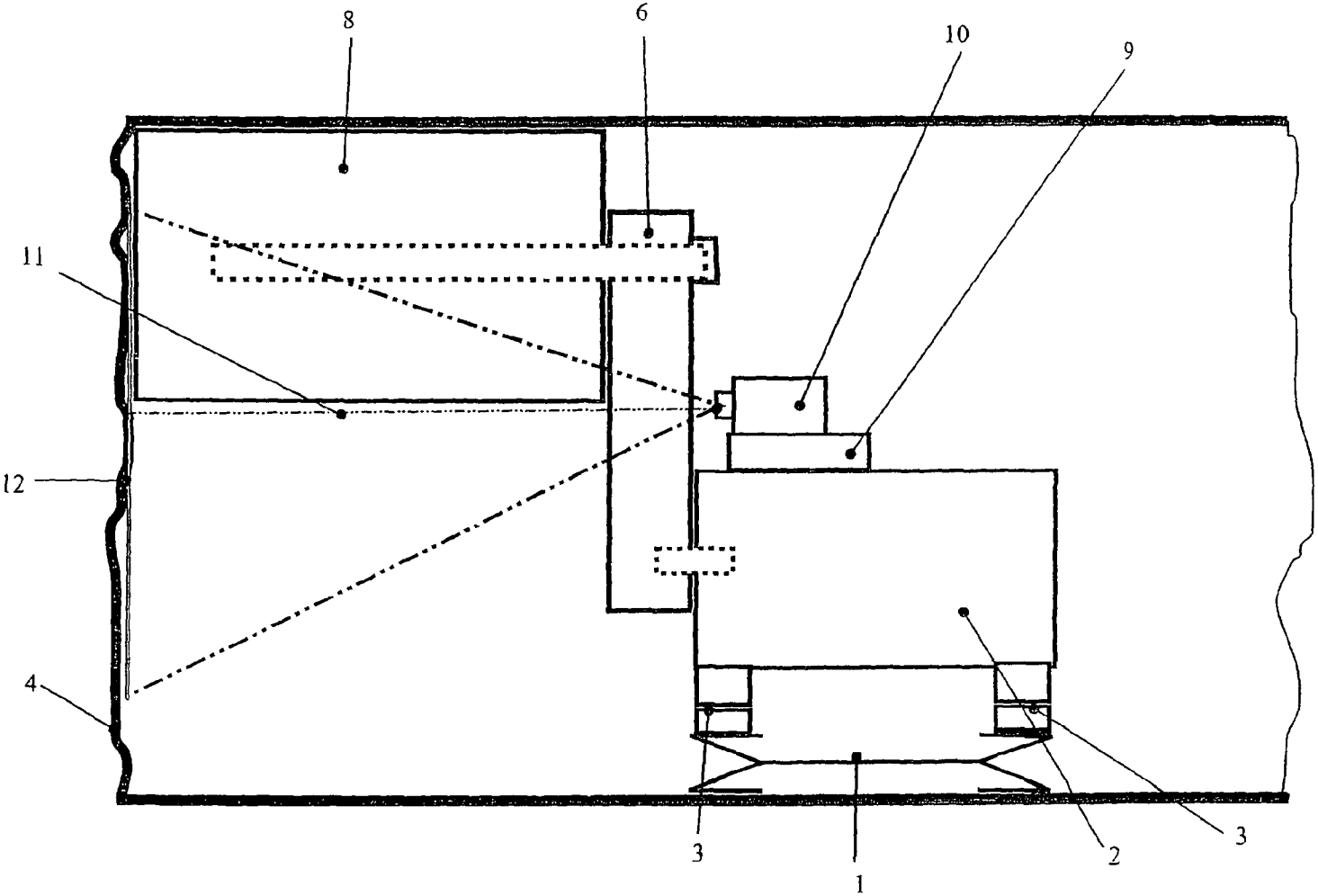
Figure 3:
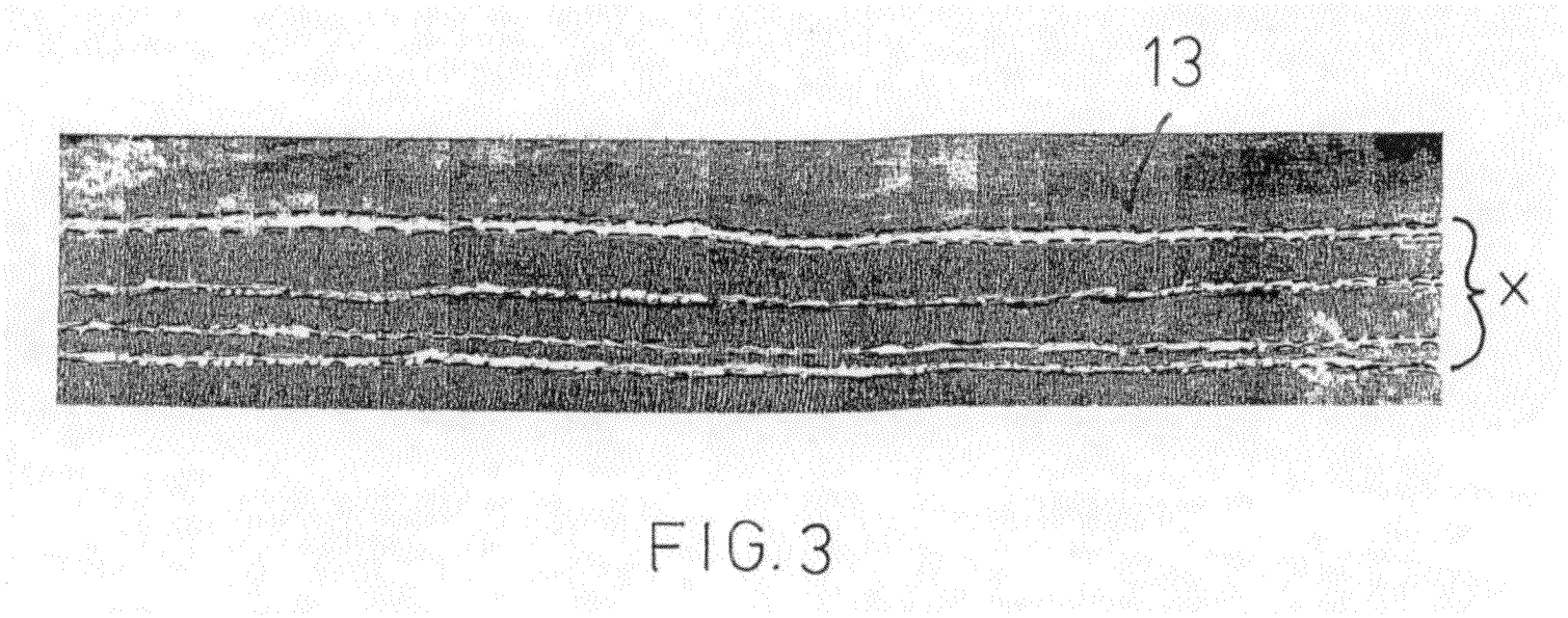

An exemplary embodiment of the invention will be described in greater detail in the following, using the attached drawing. This shows:

FIG. 1: a view of the cutting extraction machine and of the camera arrangement, seen perpendicular to the working face, FIG. 2: a section along the line II in FIG. 1, and FIG. 3: a detail of an overall heat image of the working face.

In the drawing, the machine body of a cutting extraction machine, here a cutter loader, is referred to with the reference symbol 1. This machine body is provided with slide runners 2 at the bottom, which can be displaced on a longwall conveyor 3, along the working face 4 of the longwall. The longwall conveyor 3 is thus the travel track for the cutting extraction machine, at the same time.

At the ends that lie at the front and the back in the direction of travel, pivot arms 5 and 6 are mounted on the machine body 1; these carry cutting rollers 7 and 8, in each instance, which are equipped with cutting tools at their circumference.

Approximately in the center of the machine body 1, there is a camera support 9, on which an infrared camera 10 is mounted; its optical axis 11 runs perpendicular to the working face 4.

On the working face, the infrared camera 10 records a rectangular measurement field 12, which is shown with dot-dash lines in FIG. 1. The side edges of this measurement field 12 have a distance from the cutting tools of the extraction machine, seen in the longitudinal direction of the longwall, that corresponds to at least half the width of the measurement field 12. The progression of the optical axis 11 perpendicular to the working face 4 and this minimum distance ensure that the heat measurement of the infrared camera 10 is not distorted by the cutting work of the cutting tools, by dust development, or by water mist that is sprayed in. Of course, it is best if the distance between the cutting tools of the extraction machine and the measurement field 12 of the infrared camera 10 is as great as possible. For this reason, in the exemplary embodiment, the infrared camera 10 is disposed approximately in the center of the machine body 1. In this way, the measurement field 12 of the infrared camera 10 has the greatest possible distance from all the cutting tools of the extraction machine, specifically a distance that is greater than the overall width of the measurement field 12.

The infrared camera 10 produces heat images during the extraction run of the extraction machine along the working face 4, at regular intervals; these heat images record the entire measurement field and overlap, seen in the longitudinal direction of the longwall. The individual heat images are joined together to produce an overall heat image 13, a section of which is shown in FIG. 3, at the end of the extraction run, by means of stitching. On this overall heat image 13, the layer sequence of macerals having different heat conductivity, which is characteristic for this seam, can be clearly seen. In this connection, the border surfaces between layers having different heat conductivity are emphasized by means of edge detection (Hough transformation), so that even slight differences in the heat conductivity of the individual macerals can be clearly seen.

In the evaluation of the overall heat image 13, a key bed package within the seam thickness is selected, which has a particularly characteristic sequence of border surfaces between layers having different heat conductivity. Such a key bed package is referred to with X in FIG. 1 of the exemplary embodiment. In a normal case, such a key bed package runs equidistant from the roof and the floor of the seam. For this reason, it is possible to determine, on the basis of the measured distances between the key bed package X and the upper and lower delimitation surfaces of the longwall exposed by the extraction machine, whether or not the progression of the longwall follows the progression of the seam. If there are differences in these two progressions, control data for the next extraction run of the extraction machine can be generated, which control the extraction machine in such a manner that the two progressions approximate one another again, i.e. that the progression of the longwall follows the progression of the seam as closely as possible.

The control explained above can also be improved in that another infrared camera 14 is installed on the machine body 1 of the extraction machine, which camera is directed at the newly exposed upper delimitation surface of the longwall and produces additional heat images of this upper delimitation surface. These heat images are analyzed with respect to the presence of coal or rock, in order to obtain control data that can be used to additionally control the extraction machine, during the next extraction run, in such a manner that the progression of the upper delimitation surface of the longwall follows the progression of the coal roof as precisely as possible and without any loss of coal.

The invention claimed is:

1. A method for controlling a cutting extraction machine used in coal mining comprising the steps of:

(a) conducting a plurality of extraction runs wherein in each extraction run the cutting extracting machine is moved in a longwall along a working front in longwall mining;

(b) observing during each extraction run heat radiation of a working face newly exposed by the extraction machine using an infrared camera disposed on a machine body of the extraction machine via production of heat images;

(c) determining at the end of each extraction run a progression of a key bed package with regard to at least one of an upper delimitation surface of the longwall and a lower delimitation surface of the longwall using the heat images of the working face recorded during the extraction run and generating control data for a subsequent extraction run of the extraction machine based on the progression of the key based package;

wherein the heat radiation of the working face is observed perpendicular to and at a distance from a cutting zone of cutting tools of the extraction machine;

wherein within the heat images, border surfaces between layers of coal macerals having different heat conductivity are determined via edge detection using Hough transformation; and wherein the key bed package is determined based on a characteristic sequence of border layers between coal macerals having different heat conductivity.

2. The method according to claim 1, wherein an additional heat image of the newly exposed upper delimitation surface of the longwall, in each instance, is produced using at least one additional infrared camera, and wherein the additional heat image is analyzed with regard to the presence of coal or rock, and used for generating control data for the next extraction run.

3. The method according to claim 1, wherein the distance between a measurement field of the infrared camera and the cutting zone of the cutting tools of the extraction machine is as great as possible.

4. The method according to claim 1, wherein the infrared camera is disposed centered on the machine body of the extraction machine.

5. The method according to claim 3, wherein the infrared camera is disposed centered on the machine body of the extraction machine.

* * * * *